US008990981B2

(12) United States Patent
Bensoussan

(10) Patent No.: US 8,990,981 B2
(45) Date of Patent: Mar. 31, 2015

(54) FITTED SHEET

(71) Applicant: Ubimed, Inc., Culver City, CA (US)

(72) Inventor: Jose Bensoussan, Los Angeles, CA (US)

(73) Assignee: Ubimed, Inc., Culver City, CA (US)

( * ) Notice: Subject to any disclaimer, the term of this patent is extended or adjusted under 35 U.S.C. 154(b) by 0 days.

(21) Appl. No.: 13/945,849

(22) Filed: Jul. 18, 2013

(65) Prior Publication Data

US 2015/0020311 A1 Jan. 22, 2015

(51) Int. Cl.
*A47G 9/02* (2006.01)

(52) U.S. Cl.
CPC ..... *A47G 9/0246* (2013.01)
USPC ..... 5/497

(58) Field of Classification Search
CPC ..... A47G 9/02; A47G 9/0238; A47G 9/0246; A47C 31/105; A47D 15/02
USPC ..... 5/482, 485, 488, 495–500, 502
See application file for complete search history.

(56) References Cited

U.S. PATENT DOCUMENTS 2,942,280 A * 6/1960 May, Jr. ..... 5/497
3,438,068 A * 4/1969 Anderson et al. ..... 5/497
3,940,812 A 3/1976 DiForti et al.
4,045,832 A 9/1977 DiForti et al.
4,145,778 A 3/1979 Ferrante et al.
4,237,805 A 12/1980 Ferrante et al.
4,461,049 A 7/1984 Hammond
4,596,618 A 6/1986 Hammond
4,651,370 A 3/1987 Vitale
4,703,530 A 11/1987 Gusman
4,723,331 A 2/1988 Weiss
4,773,341 A 9/1988 Brocklehurst
4,802,250 A * 2/1989 Farr ..... 5/482
4,825,489 A 5/1989 Ross
4,833,744 A 5/1989 Correa
4,841,588 A * 6/1989 Harbin et al. ..... 5/494
4,856,442 A 8/1989 Brocklehurst
4,856,444 A 8/1989 Brocklehurst
4,937,904 A 7/1990 Ross
4,970,744 A 11/1990 Davis
5,042,098 A 8/1991 Stultz
5,133,273 A 7/1992 Brocklehurst
D341,982 S 12/1993 Yacenda
5,379,470 A 1/1995 Morgan
5,438,719 A 8/1995 Anthony
5,442,822 A 8/1995 Diaz
5,513,403 A 5/1996 Wooten, Jr.
5,615,425 A 4/1997 Corente
5,628,077 A 5/1997 Briganti
5,765,241 A 6/1998 Macdonald
5,901,389 A * 5/1999 Manner ..... 5/497
6,108,837 A 8/2000 Knebel, III (Continued)

*Primary Examiner* — Nicholas Polito
(74) *Attorney, Agent, or Firm* — Intellectual Property Law Offices of Joel Voelzke, APC

(57) ABSTRACT

A fitted sheet that is particularly well suited for use on a small mattress such as a child's sleeping mattress has elastic on some, but less than all, of its bottom surface periphery. The portion without elastic is wider than the portion with elastic, and defines a pocket part. A first end of the mattress is inserted into the pocket part. The pocket part holds the mattress securely while the elasticized portion is stretched and slipped over the remainder of the mattress. The pocket part not only allows for easier insertion of the mattress into that part, but also serves as a visual index that allows the user to easily identify which part of the sheet goes on which part of the mattress.

19 Claims, 6 Drawing Sheets

(56) References Cited

U.S. PATENT DOCUMENTS

| | | | | |
|---|---|---|---|---|
| D433,865 | S | 11/2000 | Willbanks | |
| 6,381,778 | B1 | 5/2002 | Peterson | |
| 6,389,621 | B1 | 5/2002 | Elliott et al. | |
| 7,100,223 | B1 | 9/2006 | Anthony | |
| 7,107,635 | B2 | 9/2006 | Henry et al. | |
| 7,140,053 | B1 | 11/2006 | Mangano | |
| 7,487,561 | B2 | 2/2009 | Ho | |
| 7,669,257 | B2 | 3/2010 | Swihart et al. | |
| 7,810,184 | B2 | 10/2010 | McCollum | |
| D679,870 | S | 4/2013 | Williams | |
| 2013/0042411 | A1* | 2/2013 | Vitale | 5/497 |

* cited by examiner

FIG. 3
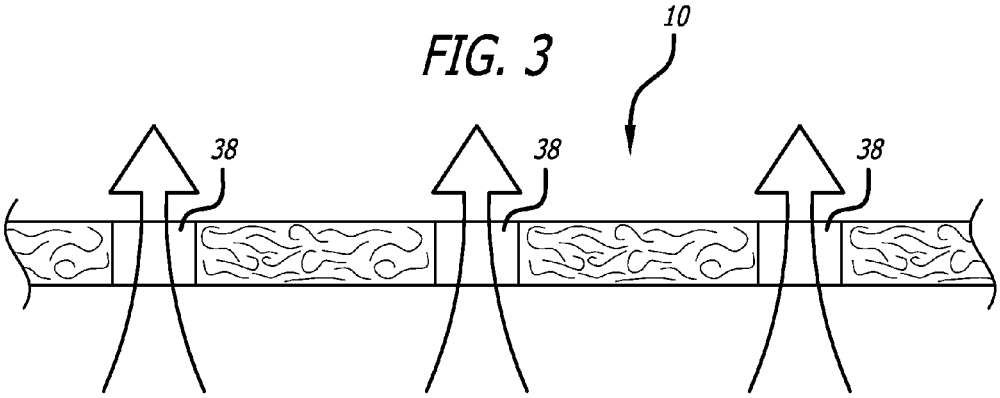
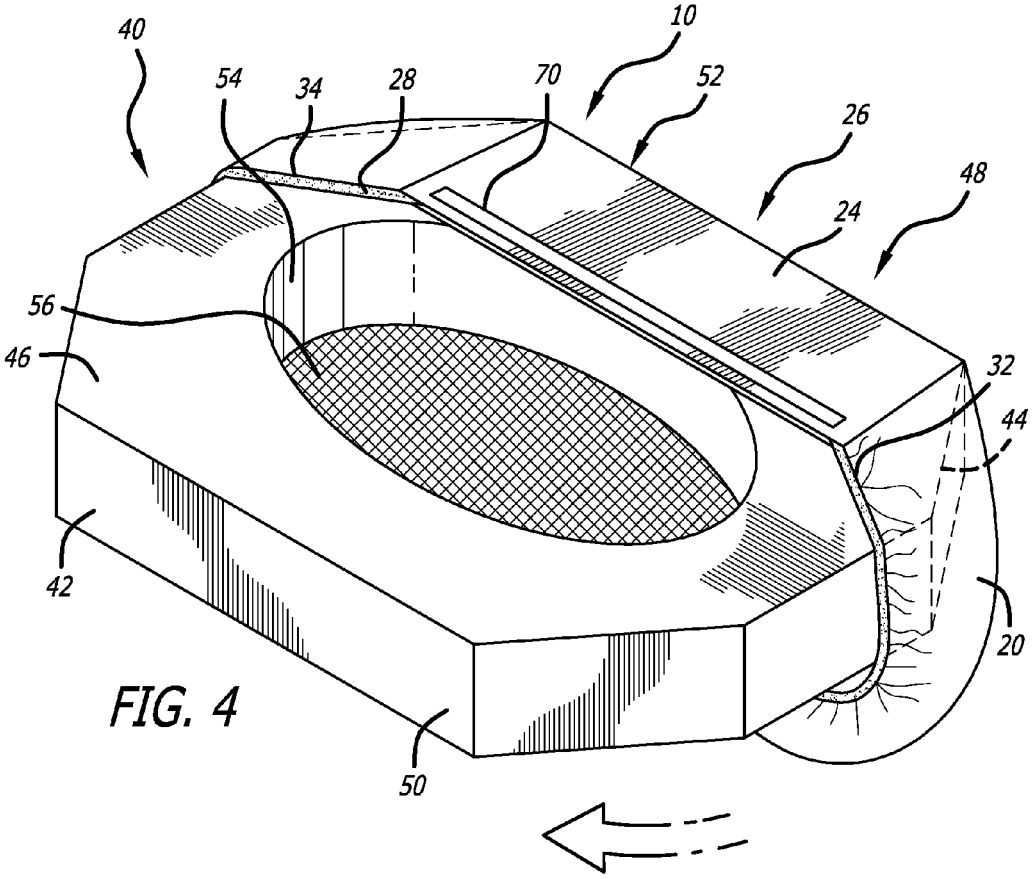
FIG. 4

FITTED SHEET

CROSS-REFERENCE TO RELATED APPLICATIONS

None.

BACKGROUND OF THE INVENTION

1. Field of the Invention

This invention relates to the field of sheets for mattresses. More particularly, this invention relates to the field of a fitted sheet for a child's sleeping mattress.

2. Description of Related Art

Fitted sheets having elastic strips sewn into the bottom in order to gather the bottom of the sheet inward thereby securely holding the sheet onto a mattress are well known.

SUMMARY OF THE INVENTION

The present invention is of a fitted sheet for a child's sleeping mattress. The sheet has an elasticized portion for the purpose of gathering the mattress inward in order to securely hold the sheet onto the mattress on which the sheet has been installed. However, only a portion of the bottom panel of the sheet is elasticized, defining an elasticized portion of the bottom panel of the sheet. The bottom panel also has an unelasticized portion which does not have an elastic strip on it. In an illustrative embodiment, the unelasticized portion extends inward toward the center of the bottom of the mattress farther than does the unelasticized portion. The unelasticized portion defines a pocket part of the sheet.

In an illustrative embodiment the pocket part serves three functions. First, the pocket part can be more easily slipped over an edge of the mattress, and particularly over the edge of a child's sleeping mattress, than if the entire bottom panel of the sheet were elasticized. That is because the elastic in a fully elasticized fitted sheet tends to gather the entire bottom of the sheet inward thus closing off to some extent the opening between the top and bottom panels of the sheet into which a leading edge of the mattress is to be inserted. By eliminating the elastic from a portion of the bottom panel of the sheet, the unelasticized portion remains more open and freely accessible to the user, thus making it easier to insert the leading edge of the mattress into that unelasticized portion.

Second, in an illustrative embodiment, the unelasticized portion of the sheet extends inwardly toward the center of the mattress's bottom more than does the average or even the maximum inward extend of the elasticized portion. The unelasticized portion thus defines a deeper pocket than the rest of the sheet. The deeper pocket securely holds the first-installed portion of the sheet, designated the leading portion of the sheet, over the respective portion of the mattress, designated the leading portion of the mattress, while the user slips the elasticized portion over the remainder of the mattress. The sheet thus overcomes a problem in prior art mattresses in which the user would place a leading portion of the sheet over a leading portion of the mattress, but while the user was stretching the remainder of the sheet over the bottom of the mattress, the leading portion could slip back off the mattress.

Third, the unelasticized portion of the mattress serves as a visual index that helps the user easily identify which portion of the sheet goes on which portion of the mattress. This eliminates a disadvantage that was observed with prior art mattresses in which the sheet in its unstretched state was gathered by the elastic strip sewn into the sheet into a somewhat amorphous form in which it was not easy to see at a glance which part of the sheet should be placed over which part of the mattress.

In one aspect therefore, the invention is of a fitted sheet, especially but not exclusively a fitted sheet for a child's sleeping mattress. The fitted sheet has a top panel having a periphery, a side extending around the top panel periphery, and a bottom panel extending from a bottom part of the side panel inward toward a center of the mattress. The bottom panel has a first and elasticized portion, the elasticized portion being drawn inward by an elastic member such as an elastic strip sewn or otherwise affixed around part of the inner edge of the bottom panel. The bottom panel also has an elongated and unelasticized portion that itself has no elastic drawing it inward. The unelasticized portion, together with an adjacent portion of the side and top panel, forms an unelasticized pocket capable of securely holding a side of the mattress while a user stretches the unelasticized portion over a bottom of the mattress. The pocket can extend to, or can extend past and thus over, at least one angled or curved side surface of the mattress.

In another aspect, the invention is of a fitted sheet for a mattress such as but not necessarily a child's sleeping mattress, the fitted sheet having a top panel, a side, and a bottom panel. The bottom panel has an inner edge in which one or more elastic strips are incorporated along some, but not all, of the inner edge. The portion of the bottom panel inner edge that does not have an elastic member incorporated therein defines at least 10% of the bottom panel inner edge, and preferably at least 20% of the bottom panel inner edge, and extends inward toward a center of the bottom of the mattress a distance that is greater than the inward extent of the elasticized portion(s).

In yet another aspect, the invention is of a method of placing a fitted sheet onto a mattress, the fitted sheet having both an elasticized portion and an unelasticized portion. The user optionally places a first side of the mattress on a surface with a second side of the mattress opposite the first side tilted upward to raise it above the surface. The user places an unelasticized and preferably extended pocket portion of the sheet over the second portion of the mattress. The pocket portion holds the second portion of the mattress securely while the user then stretches the elasticized portion over the remainder of the mattress.

Exemplary embodiments of the invention will be further described below with reference to the drawings, in which like numbers refer to like parts. The drawing figures might not be to scale, and certain components may be shown in generalized or schematic form and identified by commercial designations in the interest of clarity and conciseness.

BRIEF DESCRIPTION OF THE DRAWINGS

FIG. 3 is a side cutaway view of the fabric of FIG. 2.

FIG. 4 is an oblique view showing the bottom of a mattress with the fitted sheet of FIG. 1 partially installed thereon.

DETAILED DESCRIPTION OF THE PREFERRED EMBODIMENTS

Figure 1:
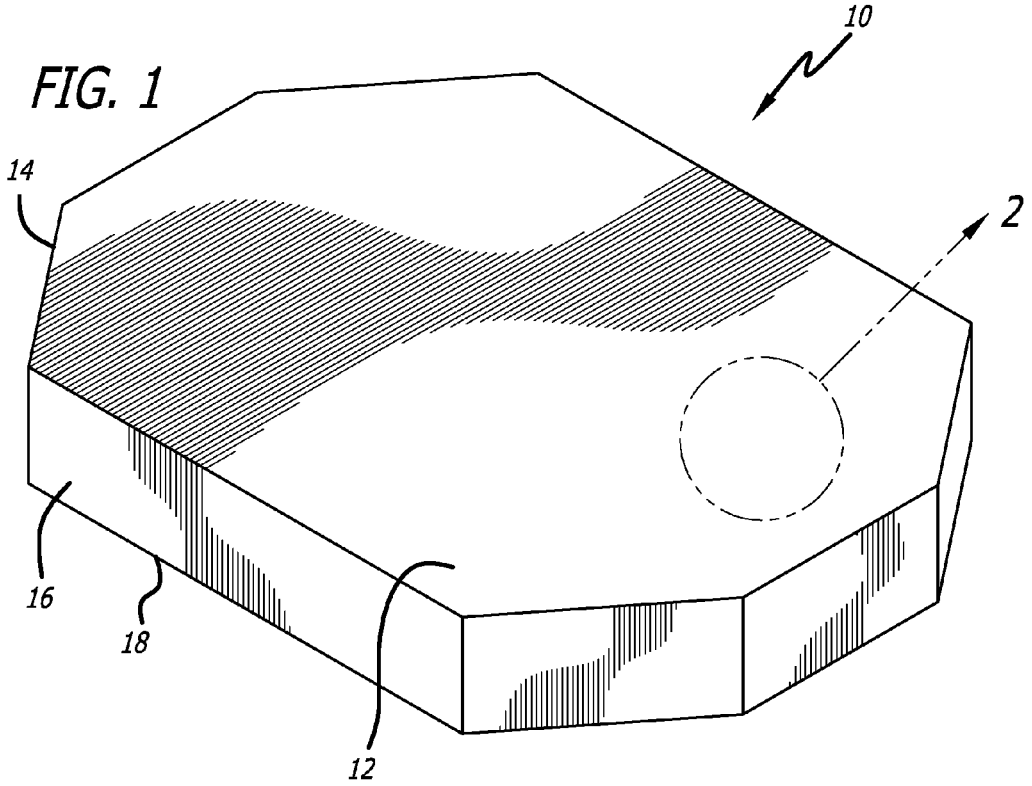
FIG. 1 is a top oblique view of a fitted sheet according to a first illustrative embodiment of the invention, the sheet being stretched to illustrate the form that it would taken when installed on a mattress.

FIG. 1 is a top oblique view of a fitted sheet 10 according to a first illustrative embodiment of the invention. Fitted sheet 10 is stretched to illustrate the form that it would take when installed on a mattress, which is not shown. Fitted sheet 10 has a top panel 12 having a periphery 14 thereof. Sheet 10 further has a side 16 and a bottom panel 20 (FIG. 4) extending from bottom part 18 of side 16. Top panel 12, side 16, and bottom panel 20 can be separate panels that have been sewn or otherwise joined together, or they can be integrally formed, or they can be all formed from a single sheet of fabric that has been cut and sewn or otherwise joined together. It is anticipated that forming the sheet from a single sheet of fabric will be the most economical. The entire sheet 10 could even be formed of a single piece of fabric without any cutting thereof. The term "panel" or "panels" as used herein should therefore not be construed to mean that different panels were formed separately and then joined together.

In a preferred embodiment the fabric of which sheet 10 including top panel 12 is formed is breathable, so that the sheet will allow flow of air therethrough and will thus be suitable for use on mattresses designed to increase air flow around the child and thus reduce incidences of Sudden Infant Death Syndrome (SIDS), such as the SIDS-preventative mattress disclosed in U.S. Pat. No. 7,752,691 to Bensoussan.

Figure 2:
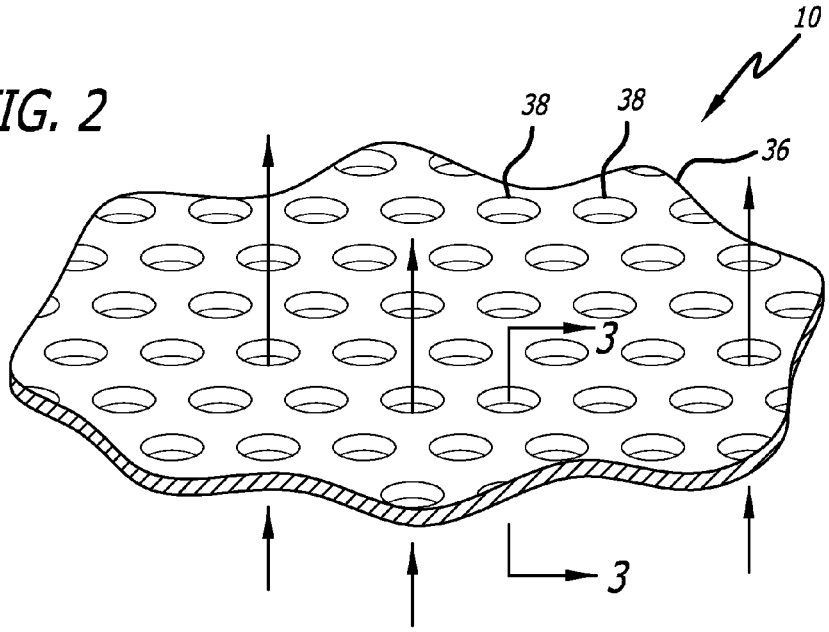
FIG. 2 is an oblique close-up view of fabric of the fitted sheet, illustrating breathability of the fabric from which the sheet is made.

FIG. 2 is an oblique close-up view of fabric 36 of the fitted sheet 10 illustrating breathability of fabric 36 from which sheet 10 is made. Fabric 36 may be made breathable by formation of small holes 38 therein. Alternatively, fibers of which sheet 12 is made could be loosely woven together leaving small openings between the fibers. A variety of breathable fabrics are known and would be suitable for use, as will be apparent to persons skilled in the art. However, it is not necessary to the invention that the fabric be breathable.

FIG. 3 is a side cutaway view of the fabric 36 of FIG. 2, showing holes 38 that allow air to pass through the sheet.

FIG. 4 is an oblique view showing the bottom of a mattress 40 with the fitted sheet 10 of FIG. 1 partially installed thereon. Mattress 40 has side 42 and bottom 46. This particular mattress includes an angled or curved side 44 because this particular mattress is a SIDS-preventative mattress such shown in U.S. Pat. No. 7,752,691. Mattress 40 also has an aperture 54 therethrough for air flow to the child, and a mesh 56 covering aperture 54. Air can thus flow through aperture 54, through mesh 56, and through breathable fabric 12 to the child.

Figure 5:
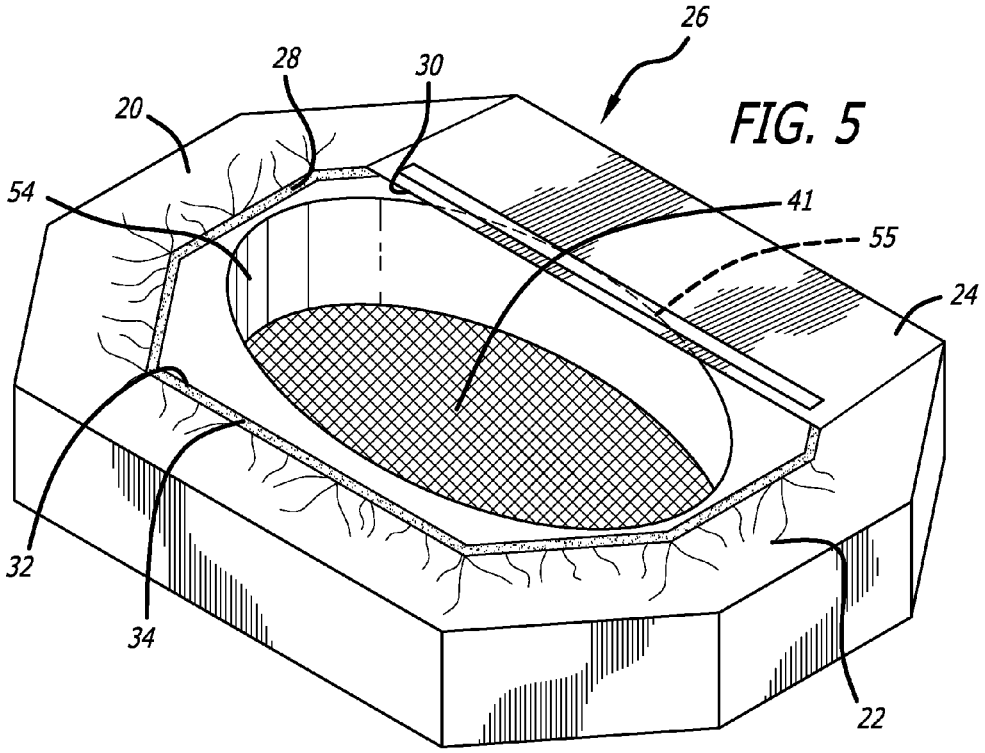
FIG. 5 is an oblique view showing the mattress and fitted sheet of FIG. 4, with the fitted sheet fully installed onto the mattress.

Fitted sheet 10 includes a bottom panel 20 having an inner edge 28. An elastic member or strip 34 is sewn or otherwise affixed to or incorporated within bottom panel 20 around a portion of inner edge 28. Bottom panel 20 has an elasticized portion 22 which includes elastic strip 34, and an unelasticized portion 24 which does not include elastic strip 34. Inner edge 28 therefore has an elasticized portion 22 which includes some or most, but not all, of inner edge 28 of the bottom of fitted sheet 10. Unelasticized portion 24 defines a pocket or pocket portion 26 of fitted sheet 10. As shown more clearly in FIG. 6, in this embodiment the unelasticized portion 24 is wider than the elasticized portions 22, that is, an inward extent 25 of the unelasticized portion 24 toward center 41 of bottom 46 of mattress 40 is greater than an inward extent 23 of elasticized portion 22. In an illustrative embodiment, elasticized portion 22 of bottom panel 20 includes at least a majority of the surface area of bottom panel 20, and the elasticized portion includes 10-45% of the surface area of bottom panel 20. In one possible embodiment, unelasticized portion 24 extends inwardy by at least 50% more than an average inward extent of elasticized portion 22. Unelasticized portion 24 may extend inward by at least 50% more than a minimum inward extent of elasticized portion 22, and may extend inward by at least 50% more than a maximum inward extent of elasticized portion 22 not including the parts of elasticized portion 22 that are immediately adjacent to unelasticized portion 24. In a contemplated embodiment, unelasticized portion 24 extends inward by more than twice an average inward extent of the elasticized portion(s). As shown in FIG. 5, the inward extent of unelasticized portion 24 extends past an edge 55 of aperture 54, whereas none of the elasticized portion 22 extends past aperture 54.

In the embodiment shown, unelasticized portion 30 of inner edge 28 defines at least 10% by distance of inner edge 28, and more preferably at least 20% by distance of inner edge 28. Further in the embodiment, the unelasticized portion covers approximately one full side, or more than one full side, of a multi-sided mattress such as multi-sided mattress 40 shown.

Sheet 10 may optionally also have a visual index 70 on pocket part 26 that facilities easy identification of the part of the sheet that is to be slipped onto the mattress first. As shown, visual index 70 is a printed bar on pocket part 26 near inner edge 28. The index could take any visually identifiable form.

The mattress has a first end 50, and a second end 52 opposite the first end. Sheet 10 is shown partially installed on second end 52. Second end 52 on which fitted sheet 10 is first placed defines what will be referred to herein as a leading end 52 of mattress 40, and the portion of fitted sheet which is first placed onto leading end 52 of mattress 40 will be referred to herein as a leading portion of fitted sheet 10. In the figure, pocket 26 has been placed over leading end 52 of mattress 40. Once the leading end 52 has been placed within pocket 26, the elasticized portions 22 of the sheet can be stretched and fitted over the other ends of the mattress without pocket 26 slipping off, as had been a problem sometimes observed with prior art fully elasticized fitted sheets.

FIG. 5 is an oblique view showing mattress 40 and fitted sheet 10 of FIG. 4, with fitted sheet 10 fully installed on mattress 40. Elastic strip 34 draws the elasticized portion 22 of bottom panel 20 including its inner edge 28 inwardly to securely hold fitted sheet 10 on the mattress. While unelasticized portion 24 itself includes no elastic strip drawing that portion inward, elastic strip 34 on elasticized portion 22 serves to draw bottom panel 20 including its inner edge 28 overall inward, and thus adequately performs the function of keeping fitted sheet 10 securely on mattress 40. In this embodiment, unelasticized pocket 26 covers one side of mattress 40, and extends along that side of the mattress to, or even over and past, at least one angled or curved portion 44 of mattress 40 at either side of unelasticized portion 24.

Figure 6:
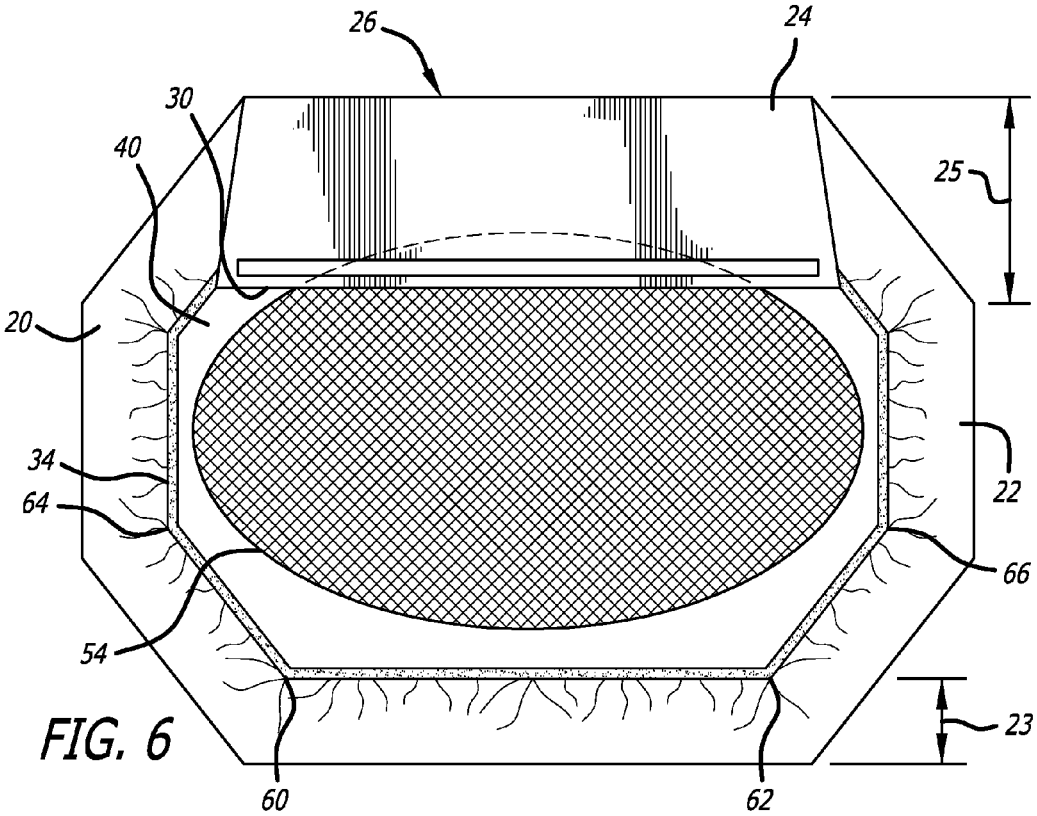
FIG. 6 is a bottom plan view showing the mattress and fitted sheet of FIG. 5.

FIG. 6 is a bottom plan view showing the mattress and fitted sheet of FIG. 5.

It is not necessary for elastic strip 34 to extend all the way around inner edge 28 except for the pocket part 26, and thus extend from a first end of pocket part 26 to a second and opposite end of pocket part 26. Alternatively, elastic strip(s) could extend only at and around sheet corners 60 and 62, or only at and around corners 60, 62, 64, and 66, or other portions of inner edge 28 sufficient to hold fitted sheet 10 on mattress 40, and thus the elastic strip(s) do not extend all the way to both ends of pocket part 26.

Figure 7:
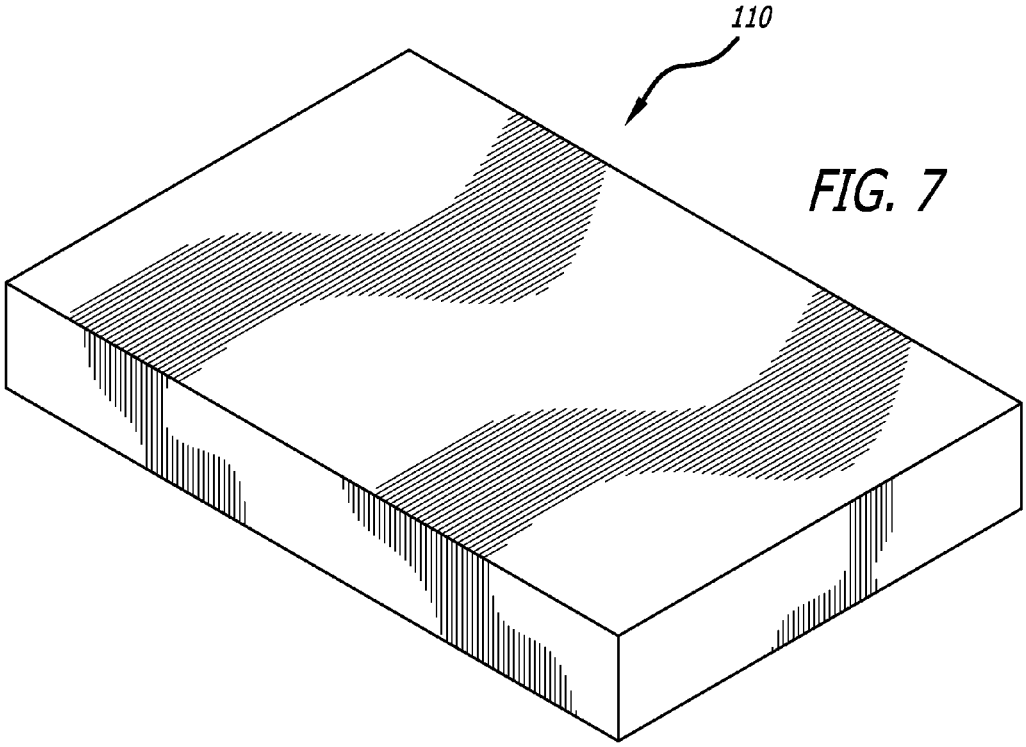
FIG. 7 is a top oblique view of a fitted sheet according to the invention for a rectangular mattress, the sheet having a pocket part along a long edge of the mattress, the sheet having been stretched to illustrate the form that it would taken when installed onto the mattress.
Figure 8:
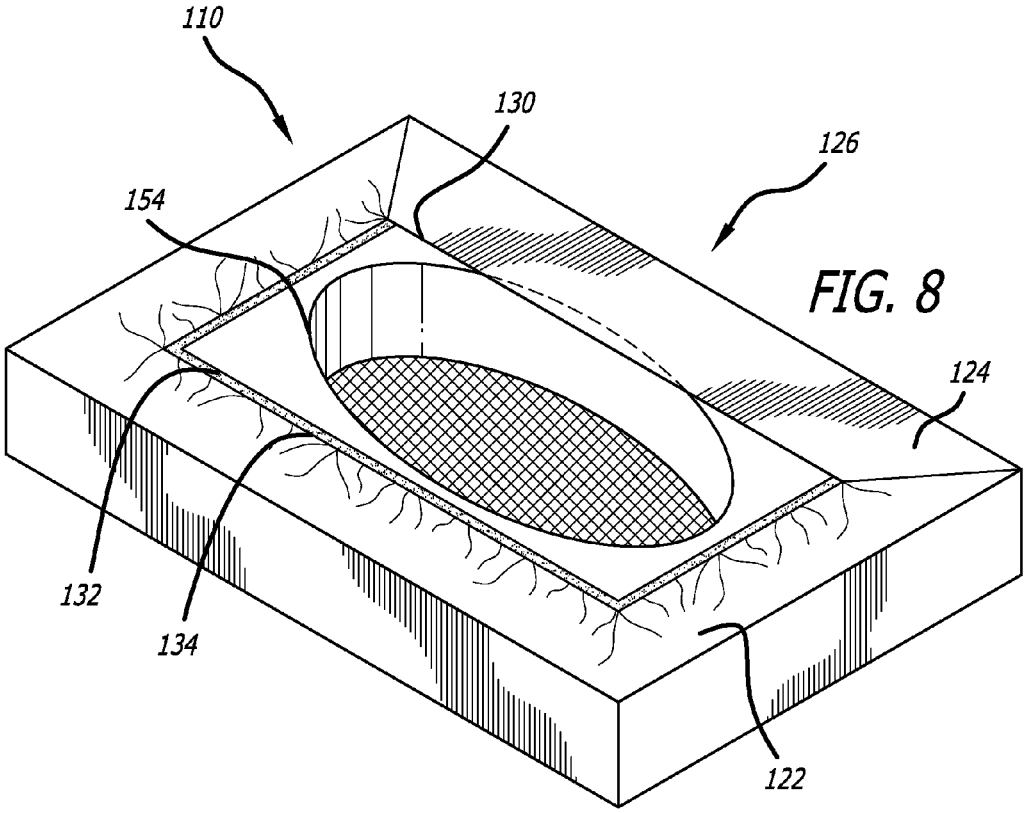
FIG. 8 is a bottom oblique view of the sheet of FIG. 7 installed on a rectangular mattress.

FIG. 7 is a top oblique view of a fitted sheet 110 according to the invention for a rectangular mattress, the sheet having a pocket part along a long edge of the mattress, the sheet having been stretched to illustrate the form that it would taken when installed onto the mattress. FIG. 8 is a bottom oblique view of the sheet 110 of FIG. 7 installed on such a mattress 140. In this embodiment the unelasticized pocket part 126 defined by extended unelasticized portion 124 of fitted sheet 110 is located along a longer side of the rectangular mattress. Unelasticized portion 130 of the inner edge defined by the absence of elastic strip 134 incorporated therein extends along a longer edge of the rectangular mattress. Elasticized portion 132 of the inner edge defined by the presence of elastic strip 134 is incorporated into the two shorter ends of rectangular mattress 140 and the long end that is opposite the end covered by pocket 126. In the embodiment as shown, the mattress has an aperture 154 in it, although the invention is not limited to use with a mattress having an aperture therein.

Figure 9:
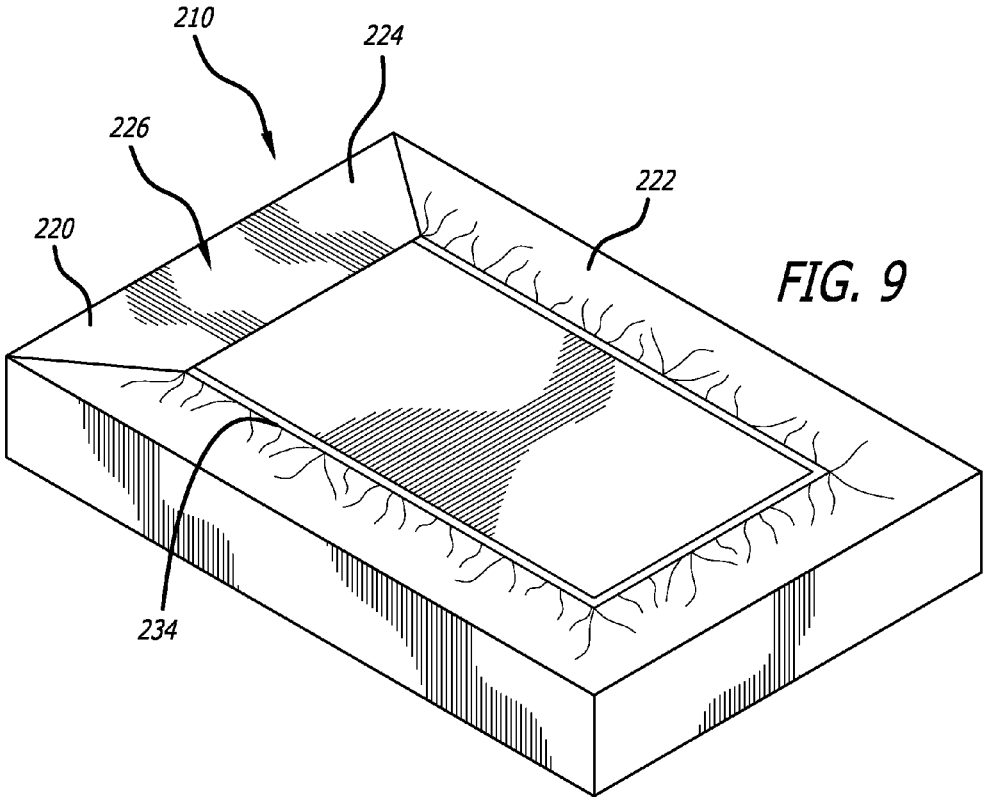
FIG. 9 is a bottom oblique view of a fitted sheet according to the invention for a rectangular mattress, the sheet having a pocket part along a short edge of the mattress.

FIG. 9 is a bottom oblique view of a fitted sheet 210 according to the invention for a rectangular mattress, the sheet 210 having a pocket part 226 defined by unelasticized part 224 of bottom panel 220 along a shorter edge of the mattress. Elastic strip 234 defining an elasticized portion 222 of bottom panel 220 is incorporated along the inner edge of bottom panel 220 along the two long sides of the mattress and along the short side that is opposite the pocket part 226. In the embodiment as shown, the mattress has no aperture in it.

Figure 10:
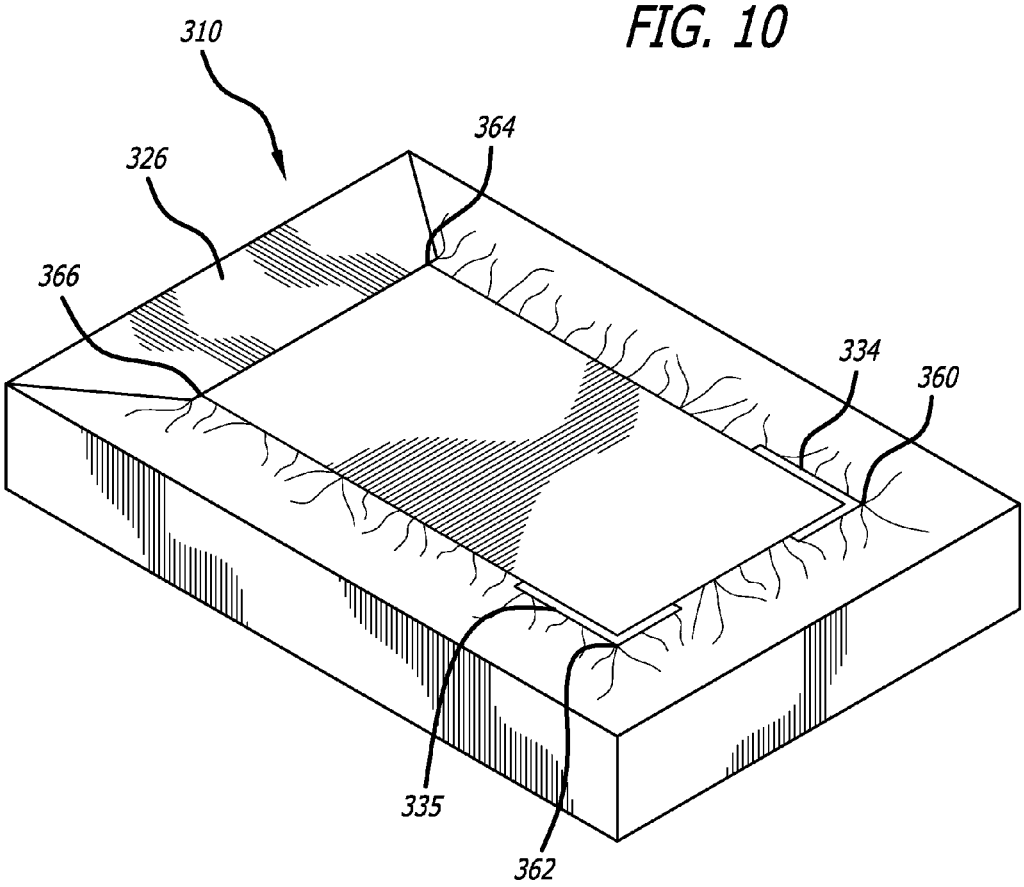
FIG. 10 is a bottom oblique view of a fitted sheet according to the invention in which the sheet has elastic strips at corners of the sheet.

FIG. 10 is a bottom oblique view of a fitted sheet according to the invention in which the sheet 310 has elastic strips 334, 335 at two adjacent corners 360, 362 of the sheet that are opposite the pocket part 326. In this embodiment, there is no elastic strip that extends as far around the mattress as does elastic strip 234 in the embodiment of FIG. 9. Instead, elastic is sewn to the sheet only at corners 360, 362 located on a first end of the sheet, but not in corners 364, 366 that are located on the opposite end of the sheet. Alternatively, the elastic strip could comprise a single elastic strip that extends at least around corners 360 and 362, and extends along some but less than all of the longer sides of the mattress.

A method of using and installing the sheet is as follows. The user positions mattress 40 so that one end 50 is resting on a surface and opposite end 52 is raised above the surface. The user inserts the unelasticized pocket part 26 of fitted sheet 10 over end 52 of the mattress that is raised above the surface, and then stretches the elastic strip 34 in elasticized portion 22 over the remaining portion of mattress 40 including mattress end 50 that is opposite end 52.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

It will be appreciated that the term "present invention" as used herein should not be construed to mean that only a single invention having a single essential element or group of elements is presented. Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

I claim:

1. A fitted sheet for a child's sleeping mattress, the fitted sheet comprising:

a top panel having a periphery thereof;

a side extending around said top panel periphery;

a bottom panel extending inwardly across a bottom of the mattress from a bottom part of the side when fitted on the mattress, wherein the bottom panel has underneath the bottom surface of the mattress when fitted thereon:

a first and elasticized portion, the elasticized portion being drawn inward by an elastic member to retain the sheet on the child's sleeping mattress when the sheet is fitted thereon, the elasticized portion having an inward extent thereof across the bottom surface of the mattress; and a second and unelasticized portion, the unelasticized portion being located positionally opposite the elasticized portion, the unelasticized portion having no elastic member thereof drawing said unelasticized portion inward;

wherein the unelasticized portion extends inwardly across the bottom surface of the mattress from the side a distance that is greater than an average inward extent of said elasticized portion.

2. The fitted sheet of claim 1 wherein said unelasticized portion, together with an adjacent portion of the side and top panel, forms an unelasticized pocket capable of securely holding a side of said mattress while a user stretches said elasticized portion over the mattress.

3. The fitted sheet of claim 1 wherein said elasticized portion includes at least a majority of said bottom panel surface, and said unelasticized portion includes between 10 and 45% of said bottom panel by surface area.

4. The fitted sheet of claim 1 wherein said unelasticized portion extends inwardly from the side a distance that is greater than the maximum inward extend of said elasticized portion.

5. The fitted sheet of claim 1 wherein the unelasticized portion extends inwardly by at least 50% more than the average inward extent of said elasticized portion.

6. The fitted sheet of claim 1 wherein the unelasticized portion has a visual index thereon near an inner edge of the unelasticized portion.

7. The fitted sheet of claim 1 wherein the unelasticized portion extends inwardly past an edge of an aperture that extends through the child's sleeping mattress, and the elasticized portion does not extend past an edge of said aperture.

8. The fitted sheet of claim 1 wherein the unelasticized portion, together with an adjacent portion of the side and the top panel, defines an unelasticized pocket that covers a side of a mattress when the sheet is fitted on the mattress, and extends along said side of the mattress to at least one angled or curved portion of the mattress at either side of the unelasticized portion.

9. The fitted sheet of claim 8 wherein the unelasticized pocket covers the at least one angled or curved portion of the mattress on either side of the unelasticized portion.

10. The fitted sheet of claim 1 wherein said top panel comprises a breathable fabric.

11. A fitted sheet for a child's sleeping mattress comprising:

a top panel, a side, and a bottom panel, the bottom panel extending inwardly across a bottom of the mattress when fitted on the mattress, the bottom panel having an inner edge that lies under the mattress when the sheet is fitted thereon;

wherein:

the bottom panel inner edge has a first part and a positionally opposite second part, the bottom panel first part having an elastic strip incorporated therein, the bottom panel second part having no elastic incorporated therein, the bottom panel inner edge second part extending inwardly across the bottom of the mattress a greater distance than does the bottom panel inner edge first part, whereby the bottom panel inner edge has an elasticized first part and an unelasticized positionally opposite second part that forms a deeper pocket than does the elasticized first part;

when the fitted sheet is fitted completely onto the child's sleeping mattress such that the bottom panel inner edge is disposed entirely underneath the mattress, the elastic strip is stretched and gathers most but not all of the bottom panel inner edge inward and underneath the mattress; and a portion of the bottom panel inner edge in which the elastic strip is not incorporated defines at least 10% by distance of the bottom panel inner edge.

12. The fitted sheet of claim 11 wherein when the sheet is fitted on the mattress, the elasticized first part of the bottom panel inner edge is disposed inwardly past an edge of an aperture that extends through the child's sleeping mattress, and the unelasticized second part of the bottom panel inner edge does not extend past an edge of said aperture.

13. The fitted sheet of claim 11 wherein the portion of the bottom panel in which the elastic strip is not incorporated extends inwardly toward a center of a bottom surface of the mattress farther than a maximum innermost extent of the portion of the bottom inner edge in which the elastic strip is incorporated.

14. The fitted sheet of claim 11 wherein the portion of the bottom panel inner edge in which the elastic strip is not incorporated defines at least 20% by distance of the bottom panel inner edge.

15. The fitted sheet of claim 11 wherein:

the sheet is integrally formed from a continuous panel of material; and the elastic strip comprises at least one elastic strip that extends around two adjacent corners on a first end of the sheet, and corners located at a second and opposite end of the sheet have no elastic located thereat.

16. The fitted sheet of claim 11 wherein:

the portion of the bottom panel inner edge in which the elastic strip is incorporated defines an elasticized portion thereof;

the portion of the bottom panel inner edge in which the elastic strip is not incorporated defines an unelasticized portion thereof; and a pocket comprising the unelasticized portion is suitable for holding securely a first portion of the child's sleeping mattress while a user stretches the elasticized portion over a remaining portion of the mattress until the fitted sheet is completely installed over said mattress.

17. The fitted sheet of claim 16 wherein the elastic strip extends continuously from a first end of the pocket to a second and opposite end of the pocket.

18. The fitted sheet of claim 16 wherein the elastic strip extends along at least two corners of the bottom panel inner edge but does not extend continuously from a first end of the pocket to a second and opposite end of the pocket.

19. A method of installing the fitted sheet of claim 16 onto said mattress, the method comprising first placing the unelasticized portion over a first part of the mattress to hold the fitted sheet thereto, then stretching the elasticized portion over a second portion of the mattress opposite the first portion.

* * * * *